United States Patent [19]

Ricketts

[11] 4,360,233

[45] Nov. 23, 1982

[54] METHOD OF BULKING AN IN SITU OIL SHALE RETORT SUBSTANTIALLY FULL OF FRAGMENTED SHALE

[75] Inventor: Thomas E. Ricketts, Grand Junction, Colo.

[73] Assignee: Occidental Oil Shale, Inc., Grand Junction, Colo.

[21] Appl. No.: 202,072

[22] Filed: Oct. 30, 1980

Related U.S. Application Data

[63] Continuation of Ser. No. 79,874, Sep. 28, 1979, abandoned.

[51] Int. Cl.[3] ..... E21C 41/10

[52] U.S. Cl. ..... 299/2; 102/312; 299/13

[58] Field of Search ..... 299/2, 13; 166/259, 166/299; 102/311, 312

[56] References Cited

U.S. PATENT DOCUMENTS

| | | | |
|---|---|---|---|
| 2,481,051 | 9/1949 | Uren | 299/2 |
| 3,001,776 | 9/1961 | Van Poollen | 299/2 |
| 3,537,753 | 11/1970 | Arendt | 299/2 |
| 3,611,933 | 10/1971 | Lanning | 102/23 |
| 3,630,283 | 12/1971 | Knutson et al. | 166/299 |
| 3,677,342 | 7/1972 | Silverman | 166/247 |
| 4,043,597 | 8/1977 | French | 299/2 |
| 4,118,070 | 10/1978 | French et al. | 299/2 |
| 4,149,595 | 4/1979 | Cha | 299/2 X |

*Primary Examiner*—Ernest R. Purser
*Attorney, Agent, or Firm*—Christie, Parker & Hale

[57] ABSTRACT

A method for forming an in situ oil shale retort in a subterranean formation containing oil shale is provided. The in situ oil shale retort has a top boundary, generally vertically extending side boundaries, and a bottom boundary of unfragmented formation. A first portion of formation is excavated for forming at least one void within the boundaries, leaving a remaining portion of formation within the boundaries adjacent the void or voids. A remaining portion of unfragmented formation within the retort boundaries is explosively expanded toward such a void for forming a fragmented permeable mass of formation particles containing oil shale in the retort. A void space remains between the upper surface of the fragmented mass and overlying unfragmented formation. A lower portion of the overlying formation is explosively expanded downwardly toward the void space for substantially filling the retort with formation particles. A sill pillar of unfragmented formation is left extending between an air level base of operation and the top boundary of the retort being formed.

35 Claims, 5 Drawing Figures

METHOD OF BULKING AN IN SITU OIL SHALE RETORT SUBSTANTIALLY FULL OF FRAGMENTED SHALE

CROSS REFERENCE TO RELATED APPLICATIONS

This is a continuation of application Ser. No. 079,874, filed Sept. 28, 1979, now abandoned.

BACKGROUND OF THE INVENTION

The presence of large deposits of oil shale in the Rocky Mountain region of the United States has given rise to extensive efforts to develop methods of recovering shale oil from kerogen in the oil shale deposits. The term "oil shale" as used in the industry is in fact a misnomer; it is neither shale nor does it contain oil. It is a formation comprising marlstone deposit containing an organic material called "kerogen" which, upon heating, decomposes to produce liquid and gaseous products. It is the formation containing kerogen that is called "oil shale" herein, the carbonaceous liquid product is called "shale oil".

The recovery of liquid and gaseous products from oil shale deposits has been described in several patents, one of which is U.S. Pat. No. 3,661,423, issued May 9, 1972, to Donald E. Garrett, assigned to the assignee of this application, and incorporated herein by this reference. This patent describes the formation of a fragmented permeable mass of oil shale particles in a subterranean formation containing oil shale by undercutting a portion of the subterranean formation leaving unfragmented formation supported by a plurality of pillars. The pillars are removed, e.g., with explosive, and the unfragmented deposit is expanded to provide a permeable mass of formation particles containing oil shale, referred to herein as an in situ oil shale retort. Hot retorting gases are passed through the in situ oil shale retort to convert kerogen contained in the oil shale to liquid and gaseous products.

One method of supplying hot retorting gases used for converting kerogen contained in the oil shale, as described in U.S. Pat. No. 3,661,423, includes establishment of a combustion zone in the retort and introduction of an oxygen supplying combustion zone feed into the retort on the trailing side of the combustion zone to advance the combustion zone through the fragmented mass. In the combustion zone, oxygen in the gaseous feed mixture is depleted by reaction with hot carbonaceous materials to produce heat and combustion gas. By the continued introduction of the oxygen supplying feed into the combustion zone, the combustion zone is advanced through the fragmented mass. The effluent gas from the combustion zone passes through the retort on the advancing side of the combustion zone to heat the oil shale in a retorting zone to a temperature sufficient to produce kerogen decomposition, called "retorting". Such decomposition in the oil shale produces gaseous and liquid products, including gaseous and liquid hydrocarbon products and a residual carbonaceous material. The resulting liquid and gaseous products pass to the bottom of the retort for collection.

It is desirable that the retort contain a reasonably uniform fragmented permeable mass of formation particles having a reasonably uniformly distributed void fraction so gases can flow uniformly through the retort resulting in maximum conversion of kerogen to shale oil. A uniformly distributed void fraction in the direction perpendicular to the direction of advancement of the combustion zone is important to avoid channeling of gas flow in the retort. In preparation for the described retorting process, it is important that the formation be fragmented and displaced, rather than simply fractured, in order to create high permeability; otherwise, too much pressure differential is required to pass gas through the retort.

It has been proposed that oil shale be prepared for in situ recovery by first undercutting a portion of the formation to remove from about 5% to about 25% of the total volume of the in situ retort being formed, leaving the unfragmented portion supported by pillars. The pillars are then explosively expanded and after a time delay the unfragmented formation is expanded by detonating explosive placed in the pillars and in the unfragmented formation. This explosive expansion of pillars and unfragmented formation fills the void created by the undercut with a fragmented permeable mass of particles.

The general art of blasting rock formations is discussed in *The Blasters' Handbook,* 15th Edition, published by E. I. duPont de Nemours & Company, Wilmington, De.

U.S. Pat. application Ser. No. 833,240 filed Sept. 14, 1977 by Gordon B. French, titled EXPLOSIVE PLACEMENT FOR EXPLOSIVE EXPANSION TOWARD SPACED APART VOIDS, now U.S. Pat. No. 4,146,272, which is assigned to the assignee of the present application, describes a method for forming an in situ oil shale retort by expanding formation toward vertically spaced apart voids containing support pillars. The pillars are explosively expanded to spread the particles thereof uniformly across the void, and unfragmented formation adjacent the void is explosively expanded toward the void before overlying, unsupported formation can cave into the void. Said U.S. patent application Ser. No. 833,240 is incorporated herein by this reference.

Application Ser. No. 929,250 filed July 31, 1978, by Thomas E. Ricketts, entitled METHOD FOR EXPLOSIVE EXPANSION TOWARD HORIZONTAL FREE FACES FOR FORMING AN IN SITU OIL SHALE RETORT, now U.S. Pat. No. 4,192,554 describes the formation of a retort and recovery of liquid and gaseous products from the retort and is incorporated herein by reference.

It has been found that it is desirable to have an intact subterranean base of operation above a fragmented permeable mass of formation particles in an in situ oil shale retort. Such a base of operation facilitates ignition over the top portion of the fragmented mass, permits control of introduction of oxygen containing gas into the retort, provides a location for testing properties of the fragmented mass such as distribution of void fraction, and provides a location for evaluating performance of the retort during operation.

The base of operation is separated from the retort by a layer of unfragmented formation extending between the top boundary of the retort and the floor of the base of operation. This layer of unfragmented formation is termed a "sill pillar". It is important that the sill pillar which acts as a barrier between the in situ oil shale retort and the base of operation remain intact during retorting operations. During retorting operations the bottom of the sill pillar can be heated due to heat generated in the retorting operation, thereby causing sloughing of the bottom portion of the sill pillar into the retort. The sloughing of formation from the bottom of the sill pillar can weaken the sill pillar, thereby causing the sill pillar to lose structural integrity.

It can, therefore, be important to provide the sill pillar with support, thereby enhancing the probability that such a sill pillar will remain structurally sound during the retorting operation.

SUMMARY OF THE INVENTION

This invention relates to a method of recovering liquid and gaseous products from an in situ oil shale retort in a subterranean formation. The in situ oil shale retort contains a fragmented permeable mass of formation particles containing oil shale. The in situ oil shale retort has a top boundary, generally vertically extending side boundaries, and a bottom boundary of unfragmented formation.

An upper level base of operation is excavated at an elevation above the elevation of the top boundary. The upper level base of operation has a sufficient horizontal cross-section for providing effective access over substantially the entire horizontal cross-section of the fragmented mass being formed. A first portion of formation is excavated forming at least one void within the boundaries of the retort being formed and leaving a remaining portion of formation within the boundaries adjacent such a void. A remaining portion of unfragmented formation is explosively expanded toward such a void for forming a first fragmented permeable mass of formation particles in the retort. A void space remains between the upper surface of the first fragmented mass and overlying unfragmented formation below the floor of the base of operation. A lower portion of the overlying formation is explosively expanded downwardly toward the void space for providing a second fragmented permeable mass of formation particles, such a second fragmented permeable mass of formation particles substantially filling the void space, and leaving a horizontal sill pillar of unfragmented formation between the top boundary and the overlying base of operation.

An oxygen supplying gas is introduced into the retort from the upper level base of operation for establishing a combustion zone in the fragmented permeable mass of formation particles. Hot combustion gases from the combustion zone establish a retorting zone on the advancing side of the combustion zone wherein oil shale is retorted to produce liquid and gaseous products. Oxygen supplying gas is introduced on the trailing side of the combustion zone for advancing the combustion zone and the retorting zone through the fragmented permeable mass. Liquid and gaseous products are withdrawn from the retort.

DRAWINGS

These and other aspects of the invention will be more fully understood by referring to the following detailed description and the accompanying drawings in which.

Figure 1:
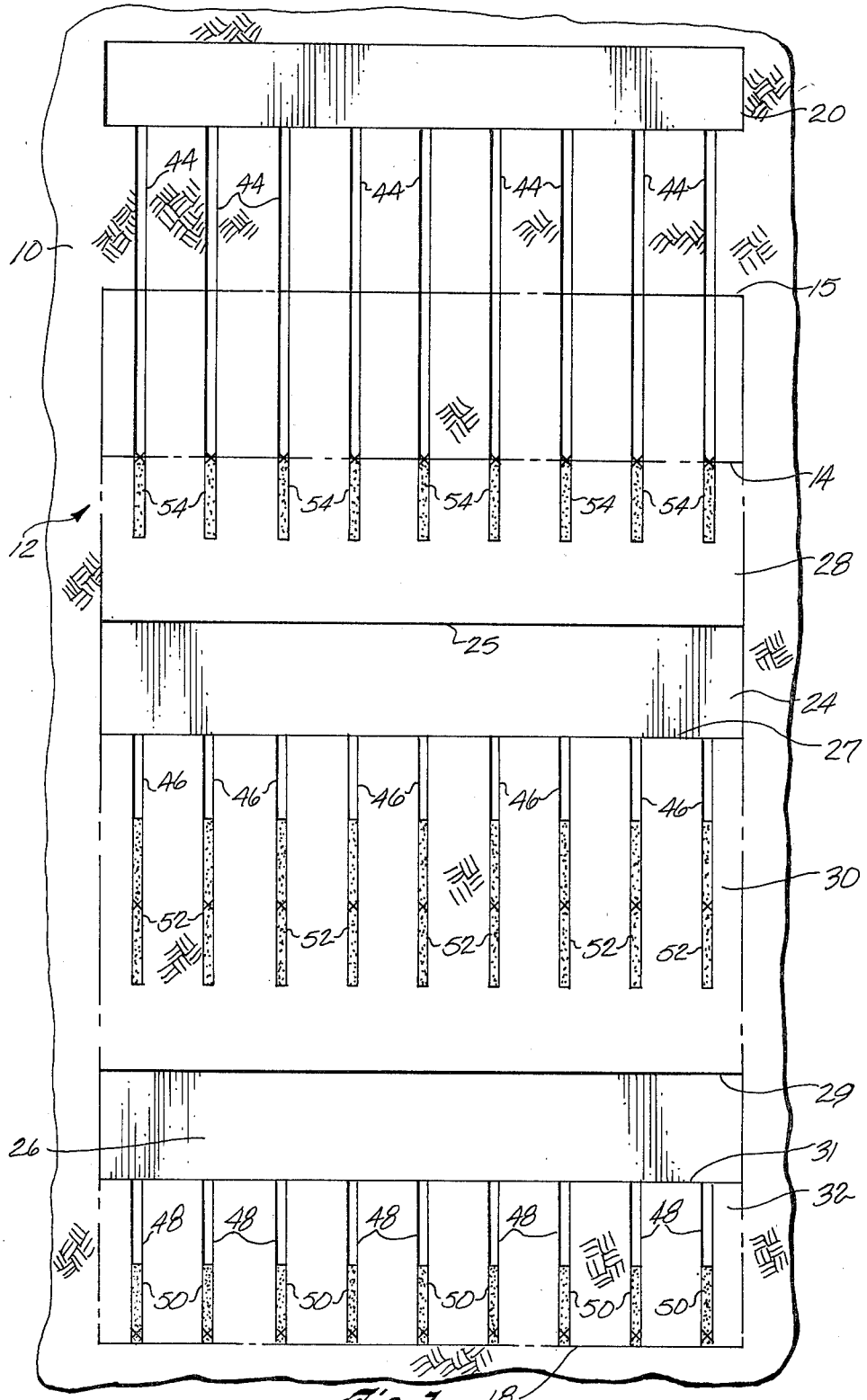
FIG. 1 is a fragmentary, semi-schematic vertical cross-sectional view showing a subterranean formation containing oil shale prepared for explosive expansion for forming an in situ oil shale retort according to principles of this invention.
Figure 2:
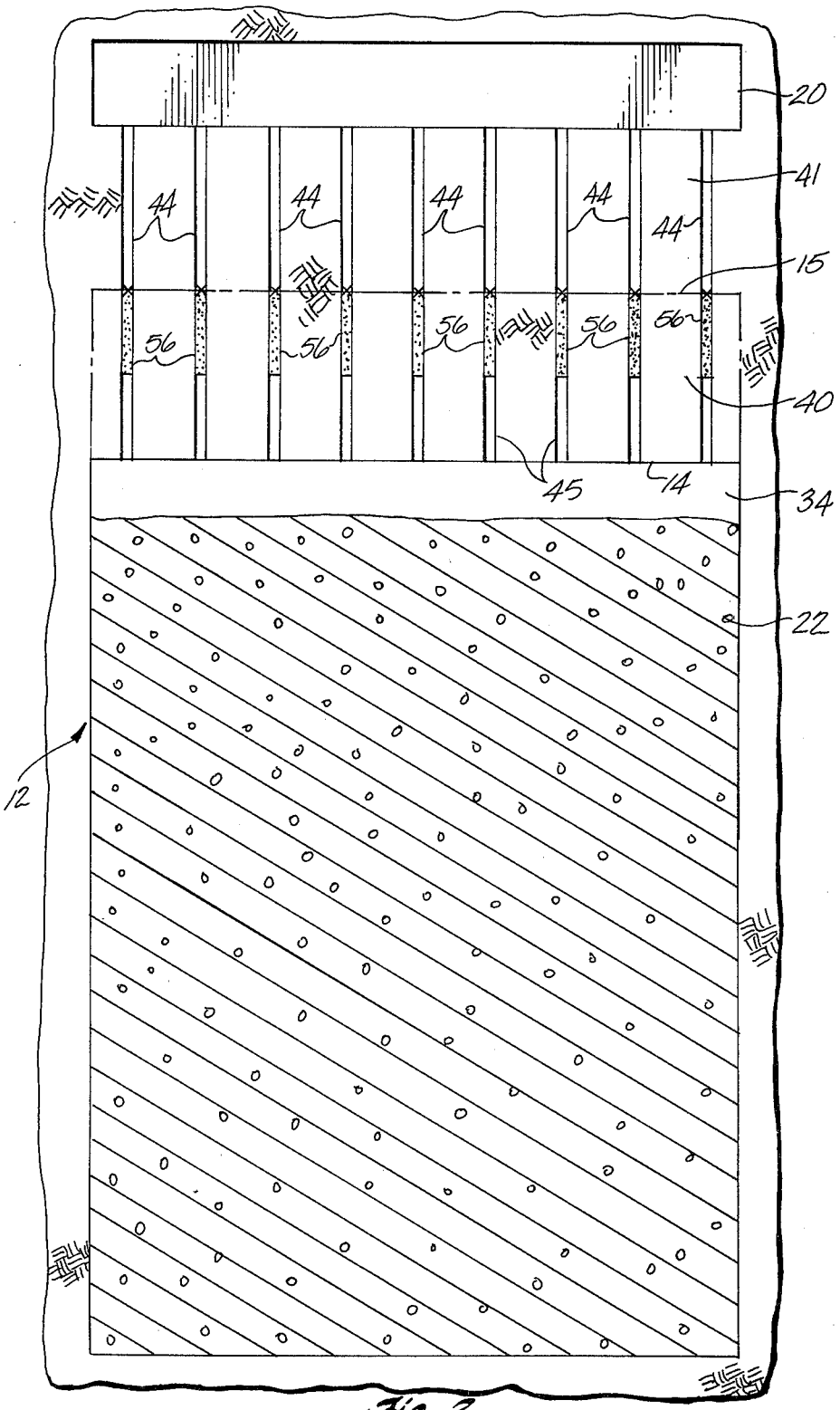
FIG. 2 is a fragmentary, semi-schematic vertical cross-sectional view of the oil shale retort being formed according to principles of this invention after a first explosive expansion.
Figure 4:
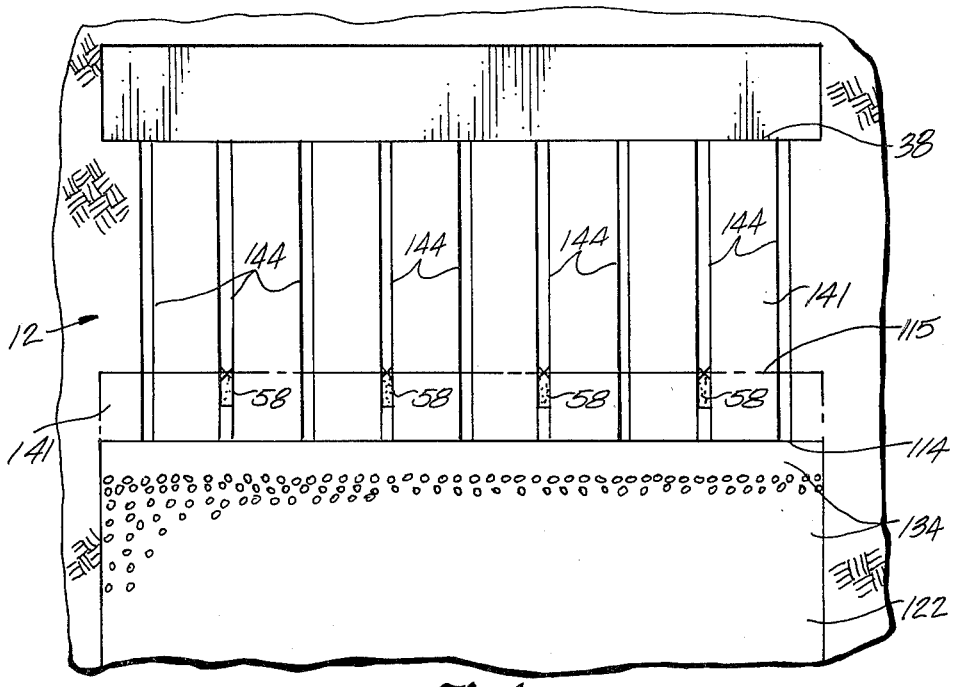
Figure 5:
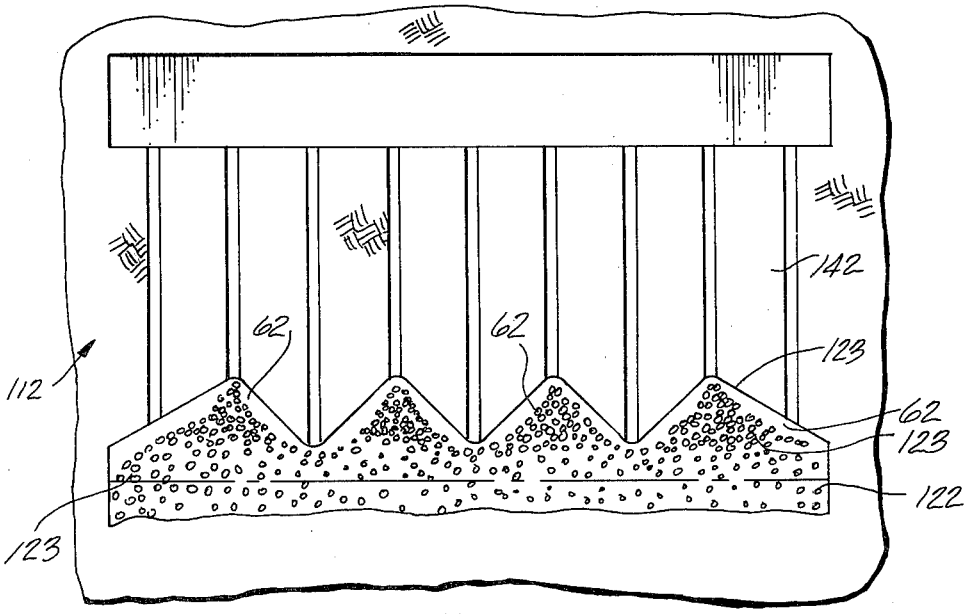

FIG. 4 is a fragmentary, semi-schematic vertical cross-sectional view of an in situ oil shale retort similar to the in situ oil shale retort of FIGS. 1 and 2 showing an alternate method of forming a fragmented permeable mass of formation particles; and FIG. 5 is a fragmentary, semi-schematic vertical cross-sectional view of the retort of FIG. 4 after completion of the formation of the fragmented permeable mass of formation particles.

DETAILED DESCRIPTION

Referring to FIGS. 1 and 2, there is shown a subterranean formation 10 having an in situ oil shale retort 12 being formed therein. FIGS. 1 and 2 are semi-schematic vertical cross-sectional views of the retort 12 being formed, the retort having a substantially horizontal interim top boundary 14, vertically extending side boundaries 16, and a bottom boundary 18 of unfragmented formation. The retort 12 is rectangular in horizontal cross-section. The retort also has a final top boundary 15 formed as described hereinafter.

Formation is excavated to form an upper level base of operation 20 above the interim top boundary 14. The upper level base of operation has a sufficient horizontal cross-section for providing effective access over substantially the entire horizontal cross-section of a fragmented permeable mass of formation particles being formed.

A first portion of formation is excavated to form at least one substantially horizontal void within the boundaries of the retort being formed, and a remaining portion of formation is left within the boundaries adjacent such a void or voids. In an exemplary embodiment, formation is excavated to form a substantially horizontal upper void 24 and a substantially horizontal lower void 26. The upper void and lower voids can occupy between about 15% to about 35% of the total volume of formation within the boundaries of the retort being formed.

The remaining portion of unfragmented formation left within the interim top boundary, side boundaries, and bottom boundary of the retort being formed in the exemplary embodiment comprises an upper zone of unfragmented formation 28 adjacent and above the upper void 24, an intermediate zone of unfragmented formation 30, and a lower zone of unfragmented formation 32. The upper zone of unfragmented formation has a horizontal free face 25 at the roof of the upper void 24. The intermediate zone of unfragmented formation extends vertically between the upper void 24 and the lower void 26. The intermediate zone of unfragmented formation has a substantially horizontal upper free face 27 adjacent and below the upper void and a substantially horizontal lower free face 29 adjacent and above the lower void. The lower zone of unfragmented formation 32 extends between the bottom boundary 18 of the retort being formed and the lower void 26. The lower zone of unfragmented formation has an upper free face 31 which is adjacent and below the lower void.

The remaining portion of unfragmented formation in the exemplary embodiment described above is prepared for explosive expansion toward the upper and lower voids by drilling blastholes into the upper, intermediate, and lower zones of such remaining portion of unfragmented formation. For example, an array of spaced apart blastholes 44 can be drilled into the upper zone of unfragmented formation 28 from the upper level base of operation 20. An array of spaced apart blastholes 46 can be drilled into the intermediate zone of unfragmented formation 30 from the upper void 24 and an array of spaced apart blastholes 48 can be drilled into the lower zone of unfragmented formation 32 from the lower void 26. The blastholes are shown out of proportion in the figures for clarity of illustration, i.e., the blasthole diameter is actually much smaller in comparison to the size of the retort being formed than is shown in the figures.

An array of blastholes may comprise any number of rows of blastholes and any number of blastholes in a row, similarly the blastholes may be arranged in any configuration, e.g., triangular, rectangular, pentangular, etc.

In an exemplary embodiment, the array of spaced apart blastholes 44 comprised an array of blastholes having nine rows of blastholes with nine blastholes in each row. The array of spaced apart blastholes 44 was a square array having equal spacing distance between adjacent blastholes, i.e., the sides of each rectangle defined by each four adjacent blastholes are equal.

The arrays of blastholes drilled into the intermediate and lower zones of unfragmented formation are substantially identical to the array of blastholes 44 drilled into the upper zone of unfragmented formation.

Explosive is loaded into the blastholes 48 in the lower zone of unfragmented formation for explosively expanding substantially the entire lower zone of unfragmented formation toward the lower void 26. Detonators designated by an "x" are placed into the bottom of the blastholes at about the bottom boundary 18 of the retort being formed. Explosive is then loaded into the blastholes 48 for providing explosive charges 50. Preferably, the explosive charges 50 extend from the bottom boundary 18 of the retort being formed about half the distance to the upper free face 31 of the lower zone of unfragmented formation. It is believed that the most efficient use of explosive occurs when the length of each explosive charge is about one-half the thickness of unfragmented formation to be explosively expanded.

The blastholes 46 in the intermediate zone of unfragmented formation in the exemplary embodiment are loaded with explosive for explosively expanding about the upper half of the intermediate zone of unfragmented formation toward the upper void and about the lower half of the intermediate zone of unfragmented formation toward the lower void. The blastholes 46 are drilled about three-fourths of the distance through the intermediate zone of unfragmented formation from the upper void. Explosive is placed into each of the blastholes 46 until each blasthole is about one-third full of such explosive. A detonator designated by an "x" is placed into each blasthole for providing detonators at about the center of height of the intermediate zone of unfragmented formation. Additional explosive is then placed into each of the blastholes until each blasthole is filled about two-thirds full of explosive, thereby forming an explosive charge 52 in each of the blastholes of the intermediate zone of unfragmented formation.

The blastholes in the upper zone of unfragmented formation are loaded with explosive for explosively expanding a lower portion of the upper zone of unfragmented formation toward the upper void 24. The blastholes 44 in the upper zone of unfragmented formation are loaded with explosive for forming explosive charges 54 and detonators designated by an "x" are loaded into each of the blastholes above the explosive charge. The upper end of each explosive charge 54 is at the interim top boundary 14 of the retort being formed.

The remaining portion of unfragmented formation, i.e., the lower, intermediate, and the lower portion of the upper zone of unfragmented formation are explosively expanded in a first single round of explosions toward the voids for forming a first fragmented permeable mass of formation particles 22 within the interim top boundary, bottom, and side boundaries of the retort as shown in FIG. 2.

Although the exemplary embodiment of FIG. 1 shows the upper void 24 and lower void 26 substantially completely devoid of unfragmented formation, unfragmented formation can be left within such voids for forming pillars of unfragmented formation between the floor and roof for temporary support of overburden prior to explosive expansion. When voids are formed having pillars of unfragmented formation, the pillars are explosively expanded first and thereafter unfragmented formation from above and/or below the void is explosively expanded into the void to form the fragmented permeable mass of formation particles in the retort.

Additional details of explosively expanding unfragmented formation can be obtained from patent application Ser. No. 929,250 which is incorporated by reference hereinabove.

It has been found that when explosively expanding unfragmented formation toward a horizontal void of limited volume, such a limited void may not be completely filled with the resulting fragmented permeable mass of formation particles. A limited void or void of limited volume is a void having a volume less than the volume required for free expansion of all the oil shale explosively expanded toward such a void. It is believed that with oil shale confined by surrounding walls and capable of expanding only to such a limited void, gases from the detonation may not have full opportunity to act on the expanding formation before the oil shale particles reach obstructions, such as adjacent walls, a face opposite to the expanding formation, or oil shale expanding from the opposite sides of the void.

In the exemplary embodiment, for example, the retort 12 being formed has a lower void 26 and an upper void 24 which comprise about 30% of the total volume within the boundaries of such a retort being formed and both the upper void and lower void act as limited voids. Explosive charges are detonated for explosively expanding the zones of unfragmented formation toward such limited voids. In an exemplary embodiment, the explosive charges have a scaled point charge depth of burial of about 11.0 millimeters per calorie to the $\frac{1}{3}$ power (mm/cal$^{\frac{1}{3}}$) and each array of explosive charges has an equivalent scaled point charge depth of burial of about 8.5 millimeters per calorie to the $\frac{1}{3}$ power. The void fraction of the resulting first fragmented permeable mass of formation particles 22 is about 24% in the retort being formed, i.e., less than the 30% available void volume.

The scaled point charge depth of burial (SDOB) as it applies to cratering and blasting to horizontal free faces is discussed in a paper by Bruce B. Redpath entitled "Application of Cratering Characteristics to a Conventional Blast Design", a copy of which accompanies this application.

The scaled point charge depth of burial of an explosive charge can be expressed in units of distance over weight to the $\frac{1}{3}$ power or, preferably, distance over the energy of explosive to the $\frac{1}{3}$ power (e.g., $SDOB = L/W^{\frac{1}{3}}$ in units of mm/cal$^{\frac{1}{3}}$).

The distance, L, referred to as burden distance in the equation for scaled point charge depth of burial, is the actual depth of burial. The burden distance is measured from the free face of the unfragmented formation toward which the unfragmented formation is to be explosively expanded to the center of mass of the explosive charge. The weight, W, or energy of the explosive is the total weight or energy of the column of explosive.

Bulking factor (BF) is defined as the percentage increase in volume of unfragmented formation when such unfragmented formation is explosively expanded. The bulking factor (BF) is related to the void fraction of a fragmented permeable mass of formation particles by the equation:

$$BF = VF/1 - VF)$$

where VF is the percentage of void space between formation particles within a given volume of fragmented permeable mass of such formation particles. Where the void fraction of the first fragmented permeable mass is about 24% as in the exemplary embodiment, the bulking factor is about 32% and only about 92.4% of the volume within the interim top boundary 14, side boundaries 16, and bottom boundary 18 of the retort 12 is filled with a fragmented permeable mass of formation particles.

Referring to FIG. 2, there is a void space 34 formed between the upper surface of the first fragmented permeable mass of formation particles and the interim top boundary 14 of the retort being formed. The average void fraction of the first fragmented mass of formation particles in the exemplary embodiment is about 24% as described hereinabove and the void space 34, therefore, comprises about 7.6% of the total volume within the interim top boundary 14, side boundaries 16, and bottom boundary 18 of the retort. The first fragmented permeable mass, therefore, occupies the remaining 92.4% of the volume within the interim top boundary 14, side boundaries 16, and bottom boundary 18 of the retort.

Remaining overlying formation 41 above the void space 34 may comprise a horizontal sill pillar of unfragmented formation and such remaining overlying formation extends between the void space 34 and the floor of the base of operation. The thickness of such remaining overlying formation 41 is sufficient to substantially fill the void space 34 with a second fragmented permeable mass of formation particles and also, if desired, leave a horizontal sill pillar of unfragmented formation which has sufficient structural strength to support loads imparted to the floor of the base of operation 20 during retorting operations. The sill pillar of unfragmented formation forms a barrier between the base of operation and the retort below, wherein such a sill pillar protects the base of operation and those working therein from the heat and gases produced during the retorting operations.

It is desirable to provide support for the sill pillar of unfragmented formation during retorting operations. Retorting operations are carried out at a temperature greater than the temperature at which oil shale sloughs for the bottom of a sill pillar, i.e., greater than about 400° F. The bottom surface of the sill pillar can become heated by convection of hot gases or by radiation of heat during the retorting operation which can cause the sill pillar to slough into a void below. In addition, there may be a tendency for a sill pillar to sag when unsupported across a substantial horizontal span. Both the sagging and sloughing of formation from the bottom of a sill pillar tends to weaken the sill pillar, thereby degrading its structural integrity. It is important that the sill pillar remain sound to enable the base of operation to be used for operation of the retort. A failure of the structural integrity of a sill pillar can cause gas from the retorting operation to enter the base of operation, thereby making the base of operation uninhabitable and can, therefore, cause such a retorting operation to be significantly more costly.

It, therefore, can be desirable to substantially fill the void space 34 above the surface of the first fragmented permeable mass of formation particles 22 with formation particles prior to commencing retorting operations. The formation particles filling the void space support the sill pillar, thereby preventing sloughing of formation from the bottom of the sill pillar.

Even if there is no sill pillar, there are additional advantages to filling a void such as the void space 34 using a controlled second round of explosive expansions. For example, when the void space 34 is filled with oil shale particles prior to retorting operations, the yield from the retort is increased due to retorting of the additional oil shale. Further, when igniting a fragmented permeable mass of formation particles in a retort, additional time and fuel are required when formation is sloughing from the bottom of a sill pillar into the top of the fragmented permeable mass of oil shale particles being ignited.

Another advantage of filling the void space 34 with a second fragmented permeable mass of formation particles using a controlled second round of explosive expansions is the ability to control the permeability of this uppermost layer of formation particles in the retort. Thus, for example, oil shale from the overlying formation explosively expanded into the void space 34 can be made to have a higher than average void fraction for enhancing the permeability of this portion of the fragmented permeable mass.

It can be desirable to have a fragmented permeable mass of formation particles having a relativly higher permeability in an upper portion of the retort for enhancing gas flow laterally across the retort. Enhancing the flow of gas laterally across the retort enhances the lateral spread of the combustion zone in the retort, thereby promoting an increased yield of gaseous and liquid products from the retort.

Alternatively, if desired, a relatively low permeability layer can be formed above the first fragmented permeable mass of formation particles in the retort before overlying formation is explosively expanded into the void space. The low permeability layer, for example, can be a material such as sand or finely divided oil shale introduced into the void space after the first round of explosive expansions forming the first fragmented permeable mass of formation particles. The material can have an average permeability which is less than the average permeability of the first fragmented permeable mass of formation particles below such a layer. The low permeability layer between the principal volume of the fragmented mass in the retort and the overlying layer expanded in a second round of explosions can cause gas introduced into the retort to spread laterally across the retort above such a layer, thereby enhancing the spread of the combustion zone laterally and promoting improved yields of gaseous and liquid products as described hereinabove.

In addition, if the first fragmented permeable mass of formation particles is found by tracer tests or the like to have a gas flow channel, the region overlying the gas flow channel can be given a low permeability to partly counteract the effect of such a channel. This can be accomplished by adding a material having a low permeability to the retort prior to explosively expanding unfragmented formation toward the void space. Alternatively, a second fragmented permeable mass of formation particles can be formed having a region of first permeability and a region of second permeability. The region of first permeability, for example, can be a region of low permeability overlying such a gas flow channel and the remainder of the second fragmented permeable mass of formation particles can have a region of higher permeability to enhance gas flow laterally through a top portion of such fragmented permeable mass. It is desirable in retorting operations that the average permeability of the fragmented permeable mass of formation particles in a retort be reasonably equal across the entire horizontal cross-section of such a retort for eliminating gas flow channels, thereby providing an even distribution of gas flow through the retort. The even distribution of gas flow enhances the yield of liquid and gaseous products from the retorting operation.

After a first round of explosive expansions is completed forming a first fragmented permeable mass of formation particles 22, the height of the void space 34 between the upper surface of such a first fragmented permeable mass of formation particles and the interim top boundary 14 is readily determined. The thickness of the oil shale to be explosively expanded toward the void space 34 can be determined from the known bulking factors for oil shale explosively expanded by various techniques. The thickness of oil shale and the amount of explosive to be loaded into blastholes in the formation is determined. The thickness of formation to be expanded and the amount of explosive depends upon whether the entire void space is to be filled, only portions of the void space are to be filled, or a second fragmented permeable mass is to be formed, only partly filling the void and leaving a void space of desired height over substantially the entire upper surface of such a second fragmented permeable mass.

Referring again to FIG. 2, a bottom portion 40 of the remaining unfragmented formation 41 overlying the void space 34 is loaded with explosive.

The bottoms of the blastholes 44 remaining in the sill pillar 41 are plugged with grout plugs 45, stemming, or the like and are loaded with explosive for providing explosive charges 56. Preferably, explosive charges 56 extend from about the top boundary 15 of the retort being formed about half the distance to the bottom surface of the remaining unfragmented formation 41 to be explosively expanded, i.e., about halfway to the interim top boundary 14 which forms a horizontal free face above the void space 34. Detonators designated by an "x" are placed into each blasthole above each explosive charge, the holes are stemmed, and the explosive charges are detonated for explosively expanding the lower portion 40 of the remaining unfragmented formation downwardly toward the void space 34 for substantially filling the entire void space with a second fragmented permeable mass of formation particles.

The bulking factor for oil shale explosively expanded toward a void space of unlimited volume is about 30–35%. Therefore, a volume of about three cubic feet of unfragmented formation is explosively expanded toward the void space 34 for each cubic foot of volume of such a void space to be filled with a fragmented permeable mass of formation particles.

When it is desired that the void fraction and permeability of the second fragmented permeable mass of formation particles be higher than the average void fraction and permeability of the first fragmented permeable mass of formation particles, the length of the explosive charges can be extended so that the explosive charge extends a distance greater than about one-half of the thickness of formation to be explosively expanded. The extension of explosive charge length places additional explosive into layers of unfragmented formation closer to the free face, i.e., closer to the bottom surface of the remaining overlying formation 41. Having additional explosive in layers of unfragmented formation closer to the free face enhances the rotation and mixing of formation particles in this region for forming a fragmented permeable mass of formation particles of increased void fraction and permeability. Alternatively, a more energetic energy of explosive charges can be used than the array used for forming the first fragmented permeable mass of formation particles. The more energetic array can be provided by using more energetic explosive charges or by decreasing spacing between blastholes. Having a more energetic array of explosive charges improves mixing and rotation of particles, thereby increasing the void fraction and thereby enhancing the permeability of the fragmented mass of formation particles being formed.

Other methods can be used to increase the permeability of the second fragmented permeable mass of formation particles, for example, by explosively expanding the bottom portion 40 of the remaining overlying unfragmented formation 41 using decked charges, wherein long delay times are provided between detonation of charges in a first deck and charges in the second and any subsequent decks.

Figure 3:
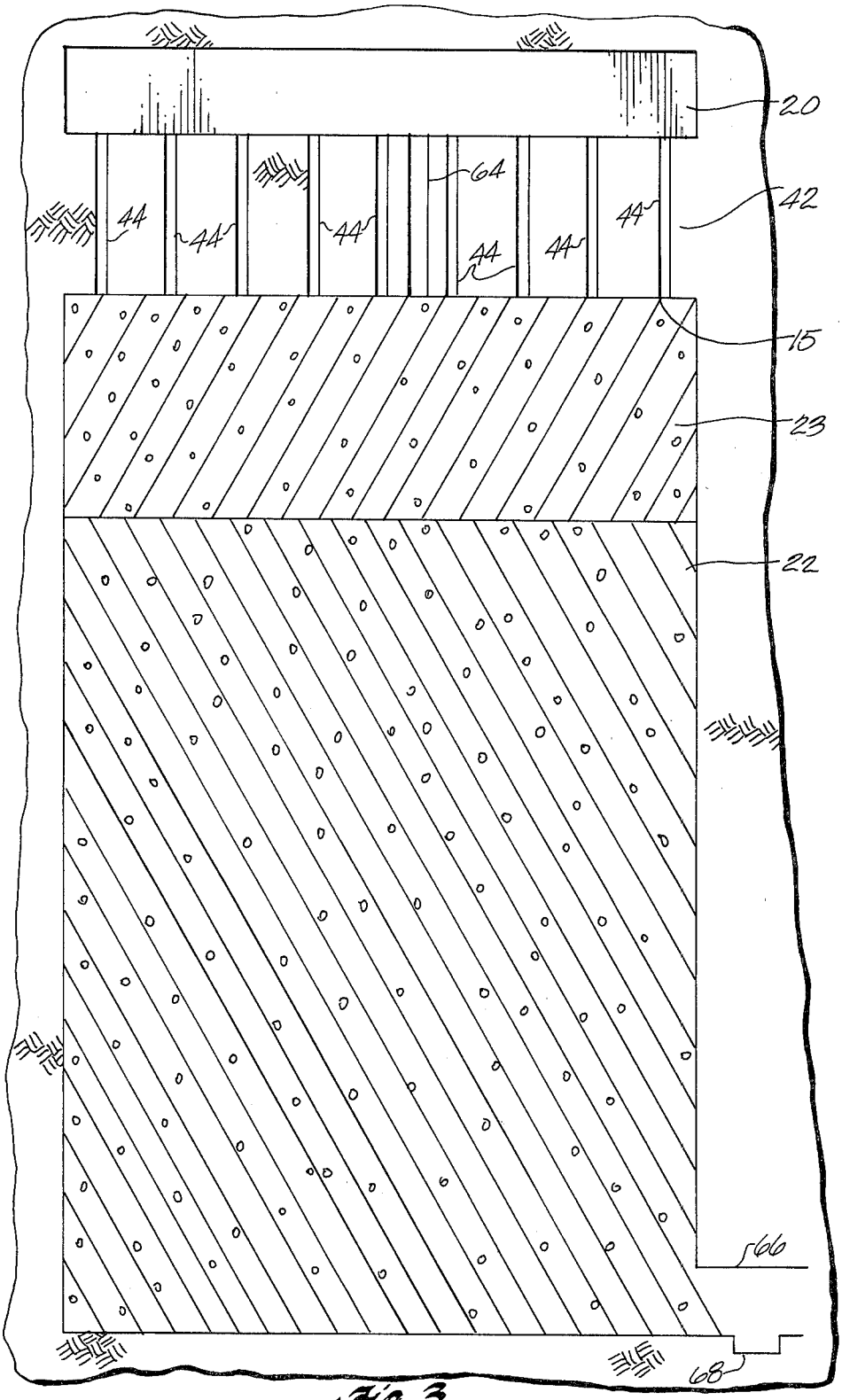
FIG. 3 is a fragmentary, semi-schematic vertical cross-sectional view of the in situ oil shale retort formed according to principles of this invention.

Referring again to FIG. 2 and additionally to FIG. 3, the void fraction of the first fragmented permeable mass of formation particles 22 in an exemplary embodiment is about 24% and is formed by explosively expanding unfragmented formation toward voids which comprise about 30% of the total volume of the retort being formed between the interim top boundary 14, side boundaries 16, and the bottom boundary 18. The size of the void space 34 is determined and the amount of formation required to be explosively expanded into such a void space for providing a second fragmented permeable mass having a void fraction of greater than about 24% is ascertained. The formation to be explosively expanded is loaded with explosive and explosively expanded toward the void space as described hereinabove. In the present embodiment, thus, a bottom portion 40 of the unfragmented formation is explosively expanded, thereby forming a second fragmented permeable mass of formation particles 23 overlying the first fragmented mass of formation particles 22. The second fragmented permeable mass of formation particles is in contact with a substantial portion of the bottom surface of a sill pillar 42 of unfragmented formation, thereby substantially filling the void space 34 and that portion of the retort extending between the interim top boundary 14 and top boundary 15 of the retort being formed.

In the illustrated embodiment, the volume of unfragmented formation explosively expanded from the upper, intermediate, and lower zones of unfragmented formation forming the first fragmented permeable mass of formation particles is larger than the volume of the lower portion 40 of unfragmented formation explosively expanded toward the void space 34. The first fragmented permeable mass of formation particles is, therefore, the principal portion of the fragmented permeable mass of formation particles formed. The second fragmented permeable mass of formation particles is a minor portion of the total fragmented permeable mass formed.

The sill pillar 42 of unfragmented formation extends between the base of operation 20 and the top boundary 15 of the retort being formed and is at least in part supported during retorting operations by the fragmented mass of formation particles in the retort. In addition, the upper portion of fragmented permeable mass of formation particles has a higher permeability than the lower principal portion of the fragmented permeable mass of formation particles, thereby enhancing gas flow across the entire lateral extent of the retort.

Although the first and second fragmented masses of formation particles are described in the exemplary embodiment as being formed by using more than one round of explosive expansions, it can be desirable to form the masses of formation particles using only a single round of explosive expansions.

When igniting a fragmented permeable mass of formation particles to form a combustion zone, it can be desired to enhance gas flow laterally across the retort in addition to the enhancement of gas flow provided by having a fragmented permeable mass of relatively high permeability such as the second fragmented permeable mass of formation particles formed as described above. Therefore, even though the entire bottom surface of the sill pillar 42 as shown in FIG. 3 is supported, it may be desirable to support such a sill pillar only in several regions of its bottom surface. Supporting a sill pillar only in several regions of its bottom surface leaves some remaining open void spaces between the bottom surface and the upper surface of the fragmented permeable mass to enhance gas flow laterally across the retort. Free communication of oxygen supplying gas is thereby provided laterally across a substantial portion of the upper surface of the fragmented permeable mass for enhancing the spread of the combustion zone laterally through such a fragmented mass.

FIGS. 4 and 5 are fragmentary, semi-schematic vertical cross-sections of an embodiment of an in situ retort 112 being formed having a sill pillar supported in regions of its bottom surface. Referring to FIG. 4, a lower principal portion 122 of the fragmented mass of particles in the retort has been formed, leaving a void space 134 between the top of the fragmented mass and an interim top boundary 114. Only a portion of blastholes 144 in an overlying zone of unfragmented formation are loaded with explosive for providing explosive charges 58. The energy of the explosive charges and thickness of formation to be explosively expanded are provided for explosively expanding only portions of the remaining unfragmented formation 141, thereby filling only portions of the void space 134. The explosive charges 58 have a charge length of about one-half the thickness of unfragmented formation to be explosively expanded. The explosive charges extend, therefore, from about the top boundary 115 of the retort being formed about one-half the distance to the bottom surface of the remaining overlying formation 141. The explosive charges are spaced apart a sufficient distance to prevent interaction between charges.

The explosive charges 58 are detonated for explosively expanding formation downwardly toward the void space 134, forming a second fragmented permeable mass of formation particles 123 above the principal fragmented permeable mass of formation particles 122. The second fragmented permeable mass of formation particles 123 is in contact with a plurality of regions of the bottom surface of the sill pillar 142 of the retort 112 being formed. The sill pillar 142 is, therefore, supported by the fragmented permeable mass of formation particles in the retort. In this embodiment, the bottom surface of the sill pillar 142 is not substantially flat, but is somewhat irregular in shape due to explosive expansion of only portions of the remaining overlying formation 141 toward the void space 134. Below the sill pillar 142, there can be void spaces 62 remaining between portions of the surface of the second fragmented permeable mass of formation particles and the bottom surface of the sill pillar 142. The void spaces 62 remaining can enhance the flow of oxygen supplying gas across the surface of the second fragmented permeable mass of oil shale particles for enhancing the ignition and lateral spread of the combustion zone. For example, although the void space is not continuous across the entire upper surface of the second fragmented permeable mass of formation particles, an oxygen supplying gas can communicate freely over substantially the entire lateral extent of the retort. The oxygen supplying gas communicates around and between those portions of the second fragmented permeable mass of formation particles which are in contact with the bottom surface of the sill pillar 142. In addition, the sill pillar is supported in a plurality of areas for reducing the amount of unfragmented formation which will slough into the void and the magnitude of sag of such a sill pillar during the retorting operations.

Alternatively, it may be desirable to merely reduce the size of a void space between the upper surface of a first fragmented permeable mass of formation particles and the bottom surface of remaining unfragmented formation without causing the second fragmented permeable mass of formation particles to have substantial contact with the bottom surface of such remaining unfragmented formation. When reducing the size of a void space, a remaining void space is provided which extends across substantially the entire upper surface of a second fragmented permeable mass of formation particles. The remaining void space enhances the flow of oxygen supplying gas across the retort, thereby enhancing the speed of a combustion zone laterally. For example, referring to FIG. 2, the void space between the upper surface of the first fragmented permeable mass and the interim top boundary 14 in an embodiment described hereinabove occupies about 7.6% of the total volume of the retort being formed between the interim top boundary 14, side boundaries 16, and lower boundary 18. When, for example, the height of the retort being formed is about 200 feet from the interim top boundary 14 to the bottom boundary 18, the height of the void space between the upper surface of the first fragmented permeable mass of formation particles and the interim top boundary is about 15 feet.

A sill pillar can be provided wherein a portion of material can slough into the void below such a sill pillar before the sill pillar becomes structurally unsound. For example, when retorting operations are commenced, material from the bottom surface of such a sill pillar can slough into the void space substantially filling the void space and thereby contacting and providing support for such a sill pillar. If the sill pillar is sufficiently thick, sloughing of the sill pillar during retorting operations may not cause the sill pillar to become structurally unsound even when voids of fairly large magnitude are left below such a sill pillar.

It is, however, not economical or desirable to form a sill pillar of sufficient thickness so as to be unaffected by sloughing of formation from the sill pillar into a void as large as the void space 34 remaining after the principal portion 22 of the fragmented mass is formed. For example, the accuracy of the placement of blastholes is important for explosively expanding unfragmented formation and this accuracy of placement is sacrificed as the thickness of the sill pillar increases. In addition, it is more costly to drill the longer blastholes which are required as the sill pillar thickness increases and sloughing of formation from the sill pillar can also increase the quantity of fuel needed for ignition and thereby reduce the effective yield from a retort.

It is believed that if no more than about one yard in height of void space remains below a sill pillar, material can slough into the void space from the bottom of the sill pillar without rendering the sill pillar structurally unsound during retorting operations. As described hereinabove, the desired height of a remaining void space depends on the amount of material which can slough from the sill pillar before the sill pillar becomes unsound. This, in turn, depends to some extent on the thickness of the sill pillar.

In an exemplary embodiment, a portion of the overlying unfragmented formation remaining is explosively expanded toward a void such as the void space 34 for providing a reduced void space of less than about three feet in height between the upper surface of a second fragmented permeable mass of formation particles and the bottom surface of the sill pillar.

Having a void height of less than about three feet enables the sill pillar to remain structurally sound during retorting operations. Additionally, having a void height of less than about three feet allows ignition of the fragmented permeable mass using less fuel and time than if the void were larger, while enhancing communication of oxygen supplying gas across substantially the entire surface of the fragmented permeable mass of formation particles, thereby enhancing the spread of the combustion zone laterally across such fragmented permeable mass.

After having formed a fragmented permeable mass of oil shale particles in the in situ oil shale retort for providing support for the sill pillar as illustrated, the final preparation steps for producing liquid and gaseous products in the retort are carried out. Referring again to FIG. 3, the final preparation steps include providing at least one gas feed inlet passage 64 downwardly from the base of operation 20 through the sill pillar 42 so that oxygen supplying gas can be introduced into the fragmented mass from the base of operation during retorting operations. If desired, at least a portion of the blastholes 44 through the sill pillar can be used for introduction of the oxygen supplying gas. A substantially horizontal product withdrawal drift 66 is formed extending away from a lower portion of the fragmented permeable mass at a lower production level. The production withdrawal drift is used for removal of liquid and gaseous products of retorting.

During retorting operations, a combustion zone is established in the fragmented permeable mass and the combustion zone is spread laterally and advanced downwardly through such fragmented mass by introduction of oxygen supplying gas into the retort. Combustion gas produced in the combustion zone passes through the fragmented mass to establish a retorting zone on the advancing side of the combustion zone, wherein kerogen in the oil shale is retorted to produce liquid and gaseous products of retorting. The liquid products and an off gas containing gaseous products passes to the bottom of the fragmented mass and are withdrawn from the product withdrawal drift 66. A pump (not shown) is used to withdraw liquid products from a sump 68 to above gound. Off gas is withdrawn by a blower (not shown) and passed to above ground.

The above description of a method of recovering oil shale from a subterranean formation containing oil shale, including the description of the formation of the fragmented permeable mass of formation particles for supporting the sill pillar, is for illustrative purposes. Because of variations which will be apparent to those skilled in the art, the present invention is not intended to be limited to the particular embodiment as described hereinabove. The scope of the invention is defined in the following claims.

What is claimed is:

1. A method of recovering gaseous and liquid products from an in situ oil shale retort in a retort site within a subterranean formation containing oil shale, such an in situ oil shale retort containing a fragmented permeable mass of formation particles containing oil shale, such an in situ retort having a top boundary, generally vertically extending side boundaries, and a bottom boundary of unfragmented formation, the method comprising the steps of:

excavating an upper level base of operation at an elevation above the elevation of the top boundary, the upper level base of operation having a sufficient horizontal cross-section for providing effective access over substantially the entire horizontal cross-section of the fragmented mass being formed;

excavating formation to form at least one substantially horizontal void in the subterranean formation, such a subterranean formation having an upper zone of unfragmented formation above such a void and a lower zone of unfragmented formation below such a void;

explosively expanding unfragmented formation from at least one of the zones of unfragmented formation toward such a void, thereby forming a principal portion of the fragmented permeable mass of formation particles and leaving a void space between the upper surface of such a principal portion of the fragmented permeable mass and the bottom surface of remaining unfragmented formation overlying such a void space;

thereafter explosively expanding a bottom portion of remaining unfragmented formation overlying such a void space, downwardly toward the void space, for forming a minor portion of the fragmented permeable mass of formation particles and leaving a sill pillar of unfragmented formation between the top boundary and the upper level base of operation for providing a barrier between the upper level base of operation and the retort during retorting operations;

introducing oxygen supplying gas into the in situ oil shale retort for establishing a combustion zone and a retorting zone in the fragmented permeable mass, wherein oil shale is retorted to produce liquid and gaseous products in the retorting zone, and for advancing the combustion zone and retorting zone through the fragmented mass; and withdrawing liquid and gaseous products from the retort.

2. The method according to claim 1 wherein the minor portion of the fragmented permeable mass of formation particles substantially fills the portion of the retort between the upper surface of the principal portion of the fragmented mass and overlying unfragmented formation.

3. The method according to claim 1 comprising the additional step of introducing a layer of material into the retort prior to explosively expanding a bottom portion of remaining unfragmented formation overlying the void space downwardly toward the void space, such a layer of material covering at least a portion of the upper surface of the principal portion of the fragmented mass, such a layer of material having a permeability less than the average permeability of the principal portion of the fragmented mass of formation particles for enhancing gas flow laterally across the retort.

4. The method according to claim 1 wherein a sufficient bottom portion of remaining unfragmented formation overlying such a void space is explosively expanded downwardly toward the void space for providing a retort having a void space of less than about three feet in height between the upper surface of the minor portion of the fragmented permeable mass of formation particles and the bottom surface of the overlying unfragmented formation.

5. The method according to claim 1 wherein a sufficient bottom portion of remaining unfragmented formation overlying such a void space is explosively expanded downwardly toward the void space for providing a minor portion of the fragmented permeable mass of formation particles, wherein portions of such a minor portion of the fragmented mass are in contact with a plurality of regions of the bottom surface of overlying unfragmented formation.

6. The method according to claim 1 wherein a sufficient bottom portion of remaining unfragmented formation overlying such a void space is explosively expanded downwardly toward the void space for providing at least a portion of the minor portion of the fragmented permeable mass of formation particles in contact with the bottom surface of overlying unfragmented formation.

7. The method according to claim 1 wherein a sufficient bottom portion of remaining unfragmented formation overlying such a void space is explosively expanded downwardly toward the void space for providing a region of relatively higher permeability and a region of relatively lower permeability in the minor portion of the fragmented permeable mass of formation particles.

8. A method of forming an in situ oil shale retort in a retort site within a subterranean formation containing oil shale, such an in situ oil shale retort containing a fragmented permeable mass of formation particles containing oil shale, the subterranean formation comprising an upper level base of operation at an elevation above the retort, the upper level base of operation having a sufficient horizontal cross section for providing effective access over substantially the entire horizontal cross section of the fragmented permeable mass being formed, the method comprising the steps of:

excavating formation to form at least one substantially horizontal void in the retort site in the subterranean formation, such as subterranean formation providing a sill pillar of unfragmented formation above such a void and a zone of unfragmented formation within the retort site adjacent such a void;

explosively expanding at least a portion of such a zone of unfragmented formation toward such a void, thereby forming a first fragmented permeable mass of formation particles in the in situ retort and leaving a void space between the upper surface of a first fragmented permeable mass of formation particles and the bottom surface of the sill pillar of unfragmented formation; and explosively expanding a bottom portion of the sill pillar toward such a void space for forming a second fragmented permeable mass of formation particles substantially filling the void space and the volume occupied by the bottom portion of the sill pillar for at least partly supporting the sill pillar for maintaining the structural integrity of the sill pillar.

9. The method according to claim 8 comprising the additional step of introducing a layer of material into the retort prior to explosively expanding the bottom portion of the sill pillar toward the void space, such a layer of material covering at least a portion of the upper surface of the first fragmented mass, and such a layer of material having a permeability less than the average permeability of the first fragmented mass for enhancing gas flow laterally across the retort.

10. The method according to claim 8 wherein a sufficient bottom portion of the sill pillar is explosively expanded downwardly toward the void space for providing the second fragmented permeable mass of formation particles in contact with at least a portion of the bottom surface of the sill pillar.

11. The method according to claim 8 wherein a sufficient bottom portion of the sill pillar is explosively expanded downwardly toward such a void space, thereby providing a remaining void space of less than about three feet in height between the upper surface of the second fragmented permeable mass of formation particles and the bottom surface of the sill pillar.

12. The method according to claim 8 wherein a sufficient bottom portion of the sill pillar is explosively expanded downwardly toward such a void space for providing the second fragmented permeable mass of formation particles, wherein portions of such a second fragmented permeable mass of formation particles are in contact with the plurality of regions of the bottom surface of the sill pillar.

13. The method according to claim 8 wherein a sufficient bottom portion of the sill pillar is explosively expanded downwardly toward such a void space, thereby forming a discontinuous void space wherein the second fragmented permeable mass of formation particles is in contact with portions of the bottom surface of the sill pillar.

14. The method according to claim 8 wherein a sufficient bottom portion of the sill pillar is explosively expanded downwardly toward such a void space for providing a region of relatively higher permeability and a region of relatively lower permeability in the second fragmented permeable mass of formation particles.

15. A method of forming an in situ oil shale retort in a retort site within a subterranean formation containing oil shale, such an in situ oil shale retort containing a fragmented permeable mass of formation particles containing oil shale, the subterranean formation comprising an upper level base of operation at an elevation above the retort, the upper level base of operation having a sufficient horizontal cross-section for providing effective access over substantially the entire horizontal cross-section of the fragmented permeable mass being formed, the method comprising the steps of:

excavating formation to form at least one substantially horizontal void in the retort site in the subterranean formation, such a subterranean formation providing a sill pillar of unfragmented formation above such a void and a zone of unfragmented formation within the retort site adjacent such a void;

explosively expanding at least a portion of such a zone of unfragmented formation toward such a void for forming a principal portion of the fragmented permeable mass of formation particles, there remaining a void space of greater than about three feet in height between the surface of the principal portion of the fragmented permeable mass of formation particles and an interim bottom surface of the sill pillar of unfragmented formation; and thereafter explosively expanding a bottom portion of the sill pillar downwardly toward the void space, forming a minor portion of the fragmented permeable mass of formation particles, there remaining no more than about three feet in height of void space between the upper surface of the minor portion of formation particles and the final bottom surface of the sill pillar.

16. The method according to claim 15 comprising the additional step of introducing a layer of material into the retort prior to explosively expanding the bottom portion of the sill pillar downwardly toward the void space, such a layer of material covering at least a portion of the surface of the principal portion of the fragmented permeable mass of formation particles, such a layer of material having a permeability less than the average permeability of the principal portion of the fragmented permeable mass of formation particles.

17. The method according to claim 15 wherein a sufficient bottom portion of the sill pillar is explosively expanded downwardly toward the void space so that the minor portion of the fragmented permeable mass of formation particles substantially fills the portion of the retort between the upper surface of the principal portion of the fragmented mass and the bottom surface of the sill pillar.

18. A method of forming an in situ oil shale retort in a subterranean formation containing oil shale, the in situ oil shale retort containing a fragmented permeable mass of formation particles containing oil shale, such an in situ oil shale retort having a top boundary, generally vertically extending side boundaries, and a bottom boundary of unfragmented formation, the method comprising the steps of:

excavating an upper level base of operation at an elevation above the elevation of the top boundary, the upper level base of operation having a sufficient horizontal cross-section for providing effective access over substantially the entire horizontal cross-section of the fragmented permeable mass being formed;

excavating a first portion of formation for forming at least one void within the boundaries of the retort being formed and leaving a remaining portion of formation within the boundaries adjacent such a void;

explosively expanding such a remaining portion toward such a void for forming a first fragmented permeable mass of formation particles in the retort, there being a void space between the upper surface of the first fragmented permeable mass and overlying unfragmented formation below the floor of the base of operation;

explosively expanding a bottom portion of the overlying formation downwardly toward the void space for providing a second fragmented permeable mass of formation particles, such a second fragmented permeable mass of formation particles substantially filling such a void space and the volume occupied by said bottom portion and leaving a horizontal sill pillar of unfragmented formation between the top boundary and the overlying base of operation for providing a barrier between the base of operation and the retort during retorting operations.

19. The method according to claim 18 comprising the additional step of introducing a layer of material into the retort prior to explosively expanding the bottom portion of overlying formation toward the void space, such a layer of material covering at least a portion of the upper surface of the first fragmented permeable mass, such a layer of material having a permeability less than the average permeability of the first fragmented permeable mass of formation particles for enhancing gas flow laterally across the retort.

20. The method according to claim 18 comprising the step of explosively expanding the bottom portion of overlying formation downwardly toward the void space for providing the second fragmented permeable mass of formation particles in contact with at least a portion of the bottom surface of the sill pillar.

21. The method according to claim 18 wherein a sufficient bottom portion of the overlying formation is explosively expanded downwardly toward the void space for providing a remaining void space of less than about three feet in height between the upper surface of the second fragmented permeable mass of formation particles and the bottom surface of the sill pillar.

22. The method according to claim 18 wherein a sufficient bottom portion of the overlying formation is explosively expanded downwardly toward the void space for providing the second fragmented permeable mass of formation particles wherein portions of such a second fragmented permeable mass of formation particles are in contact with a plurality of regions of the bottom surface of the sill pillar.

23. The method according to claim 18 wherein a sufficient bottom portion of overlying formation is explosively expanded downwardly toward the void space for forming a discontinuous void space wherein the second fragmented permeable mass of formation particles is in contact with portions of the bottom surface of the sill pillar.

24. The method according to claim 18 wherein a sufficient bottom portion of the overlying formation is explosively expanded downwardly toward the void space for providing a region of relatively higher permeability and a region of relatively lower permeability in the second fragmented permeable mass of formation particles.

25. A method of recovering liquid and gaseous products from an in situ oil shale retort in a subterranean formation, the in situ retort containing a fragmented permeable mass of formation particles containing oil shale, such an in situ retort having a top boundary, generally vertically extending side boundaries, and a bottom boundary of unfragmented formation, the method comprising the steps of:

excavating an upper level base of operation at an elevation above the elevation of the top boundary, the upper level base of operation having a sufficient horizontal cross-section for providing effective access over substantially the entire horizontal cross-section of the fragmented permeable mass being formed;

excavating a first portion of formation for forming at least one void within the boundaries and leaving a remaining portion of formation within the boundaries adjacent such a void;

explosively expanding such a remaining portion toward such a void for forming a first fragmented permeable mass of formation particles in the retort, there being a void space between the upper surface of the first fragmented permeable mass and overlying unfragmented formation below the floor of the base of operation;

explosively expanding a lower portion of such overlying formation downwardly toward the void space for providing a second fragmented permeable mass of formation particles, such a second fragmented mass of formation particles substantially filling such void space and the volume occupied by the lower portion of such overlying formation and leaving a horizontal sill pillar of unfragmented formation between the top boundary and the overlying base of operation;

introducing an oxygen containing gas into the retort from the upper level base of operation for establishing a retorting zone in the fragmented permeable mass of formation particles wherein oil shale is retorted to produce gaseous and liquid products, and for advancing the retorting zone through the fragmented permeable mass; and withdrawing the gaseous and liquid products from the retort.

26. The method according to claim 25 comprising the additional step of introducing a layer of material into the retort prior to explosively expanding the bottom portion of overlying formation downwardly toward the void space, such a layer of material covering a portion of the upper surface of the first fragmented permeable mass of formation particles, such a layer of material having a permeability less than the average permeability of the first fragmented permeable mass of formation particles for enhancing gas flow laterally across the retort.

27. The method according to claim 25 wherein a sufficient bottom portion of overlying formation is explosively expanded downwardly toward the void space for providing the second fragmented permeable mass of formation particles in contact with at least a portion of the bottom surface of the sill pillar.

28. The method according to claim 25 wherein a sufficient bottom portion of the overlying formation is explosively expanded downwardly toward the void space for providing a remaining void space of less than about three feet in height between the upper surface of the second fragmented permeable mass of formation particles and the bottom surface of the sill pillar.

29. The method according to claim 25 wherein a sufficient bottom portion of the overlying formation is explosively expanded downwardly toward the void space for providing the second fragmented permeable mass of formation particles wherein portions of such a second fragmented permeable mass of formation particles are in contact with a plurality of regions of the bottom surface of the sill pillar.

30. The method according to claim 25 wherein a sufficient bottom portion of overlying formation is explosively expanded downwardly toward the void space forming a discontinuous void space wherein the second fragmented permeable mass of formation particles is in contact with portions of the bottom surface of the sill pillar.

31. The method according to claim 25 wherein a sufficient bottom portion of the overlying formation is explosively expanded downwardly toward the void space for providing a region of relatively higher permeability and a region of relatively lower permeability in the second fragmented permeable mass of formation particles.

32. A method for recovering gaseous and liquid products from an in situ oil shale retort in a retort site in a subterranean formation containing oil shale, and in situ oil shale retort containing a fragmented permeable mass of formation particles containing oil shale within top, bottom, and generally vertically extending side boundaries of unfragmented formation, the method comprising the steps of:

excavating formation to form at least one substantially horizontal void in the subterranean formation, the subterranean formation comprising an upper zone of unfragmented formation above such a void and a lower zone of unfragmented formation below such a void;

explosively expanding unfragmented formation from at least one of the zones of unfragmented formation toward the void, thereby forming a principal portion of the fragmented permeable mass of formation particles in the in situ oil shale retort and leaving a void space between the upper surface of such a principal portion of the fragmented mass and the bottom surface of remaining unfragmented formation overlying the void space;

thereafter explosively expanding a plurality of horizontally spaced apart bottom portions of such remaining overlying unfragmented formation downwardly toward the void space, for forming a minor portion of the fragmented permeable mass of formation particles in the in situ retort, the minor portion of the fragmented mass being in contact with a plurality of regions of the bottom surface of such overlying unfragmented formation for supporting the overlying formation while void spaces remain between the minor portion of the fragmented mass and other regions of the bottom surface of such overlying unfragmented formation;

introducing oxygen-supplying gas into the in situ oil shale retort for establishing a combustion zone and a retorting zone in the fragmented permeable mass, and for advancing the combustion zone and retorting zone downwardly through the fragmented mass, thereby retorting oil shale to produce liquid and gaseous products; and withdrawing such liquid and gaseous products from the retort.

33. A method for forming an in situ oil shale retort in a retort site in a subterranean formation containing oil shale, the in situ retort containing a fragmented permeable mass of formation particles containing oil shale within top, bottom, and generally vertically extending side boundaries of unfragmented formation, the method comprising the steps of:

excavating a first portion of formation from within a retort site for forming at least one substantially horizontal void within the retort boundaries and leaving a remaining portion of formation within the retort boundaries adjacent such a void;

explosively expanding such a remaining portion of formation toward the void for forming a first fragmented permeable mass of formation particles in the retort, there being a void space between the upper surface of the first fragmented permeable mass and overlying unfragmented formation; and explosively expanding a plurality of horizontally spaced apart lower portions of such overlying formation downwardly toward the void space for providing a second fragmented permeable mass of formation particles, the second fragmented mass of formation particles being in contact with a plurality of regions of the bottom surface of remaining overlying formation while void spaces remain between the second fragmented mass of formation particles and other regions of such remaining overlying formation.

34. A method for forming an in situ oil shale retort in a retort site in a subterranean formation containing oil shale, the in situ retort containing a fragmented permeable mass of formation particles containing oil shale within top, bottom, and generally vertically extending side boundaries of unfragmented formation, the method comprising the steps of:

excavating formation from within the retort site for forming at least one substantially horizontal void within the retort boundaries, while leaving at least one zone of unfragmented formation within the retort boundaries adjacent such a void;

placing a plurality of horizontally spaced apart explosive charges in such a zone of unfragmented formation and detonating the explosive charges for expanding formation toward the void to thereby form a first fragmented permeable mass of formation particles in the retort, a void space being between the upper surface of the first fragmented permeable mass and overlying unfragmented formation; and placing a plurality of horizontally spaced apart explosive charges in a lower portion of such overlying unfragmented formation and detonating the explosive charges for explosively expanding overlying formation downwardly toward the void space for providing a second fragmented permeable mass of formation particles in the retort, the second fragmented permeable mass being in contact with a plurality of regions of the bottom surface of remaining overlying formation while void spaces remain between the second fragmented mass and other regions of such remaining overlying formation.

35. The method according to claim 34 wherein the explosive charges placed into the lower portion of such overlying unfragmented formation are spaced apart a sufficient distance to prevent interaction between charges.

* * * * *